US007222446B2

(12) United States Patent
Foster

(10) Patent No.: US 7,222,446 B2
(45) Date of Patent: May 29, 2007

(54) GREETING CARD WITH GIFT HOLDER

(75) Inventor: Daniel R. Foster, Liberty, MO (US)

(73) Assignee: Hallmark Cards, Incorporated, Kansas City, MO (US)

( * ) Notice: Subject to any disclaimer, the term of this patent is extended or adjusted under 35 U.S.C. 154(b) by 0 days.

(21) Appl. No.: 10/759,394

(22) Filed: Jan. 16, 2004

(65) Prior Publication Data

US 2004/0187368 A1 Sep. 30, 2004

Related U.S. Application Data

(60) Provisional application No. 60/440,893, filed on Jan. 17, 2003.

(51) Int. Cl.
*G09F 1/00* (2006.01)

(52) U.S. Cl. ..... 40/124.06; 40/124.11

(58) Field of Classification Search ..... 40/124.09, 40/124.11, 124.13, 124.01; 283/117; D19/2, D19/26, 32, 28; 446/147
See application file for complete search history.

(56) References Cited

U.S. PATENT DOCUMENTS

| | | | | | |
|---|---|---|---|---|---|
| 324,164 | A | * | 8/1885 | Raisbeck | 40/124.11 |
| 618,449 | A | | 1/1899 | Warner | |
| 861,748 | A | | 7/1907 | Mitchell | |
| 861,749 | A | | 7/1907 | Mitchell | |
| 1,058,830 | A | | 4/1913 | Witkowski | |
| 1,106,058 | A | | 8/1914 | Rand | |
| 1,141,172 | A | | 6/1915 | Clark | |
| 1,261,297 | A | | 4/1918 | Rummler | |
| 1,379,739 | A | * | 5/1921 | Bennett | 40/124.06 |
| 1,743,305 | A | * | 1/1930 | Banks | 229/67.1 |
| 2,298,601 | A | | 10/1942 | Tremblett | |
| 2,417,982 | A | | 3/1947 | Histed | |
| 2,504,277 | A | * | 4/1950 | Otterson | 40/124.11 |
| 2,887,327 | A | | 5/1959 | Tucker | |
| 3,001,690 | A | | 9/1961 | Peterson | |
| 3,190,541 | A | | 6/1965 | McLaughlin et al. | |
| 3,638,343 | A | * | 2/1972 | West | 40/124.06 |
| 3,672,703 | A | | 6/1972 | Jay | |
| 3,684,084 | A | | 8/1972 | Kanzelberger | |
| 4,430,843 | A | | 2/1984 | Favale | |
| 4,433,780 | A | | 2/1984 | Ellis | |
| 4,434,889 | A | | 3/1984 | Fery | |
| 4,485,962 | A | * | 12/1984 | Farley | 229/67.1 |
| 4,497,126 | A | * | 2/1985 | Dejean | 40/124.02 |
| 4,722,376 | A | | 2/1988 | Rhyner | |
| 4,765,466 | A | | 8/1988 | Ivey | |
| 4,840,275 | A | * | 6/1989 | Faiola et al. | 206/423 |
| 4,887,763 | A | | 12/1989 | Sano | |

(Continued)

FOREIGN PATENT DOCUMENTS

WO WO 9323254 A1 * 11/1993

*Primary Examiner*—Gary C. Hoge
(74) *Attorney, Agent, or Firm*—Fish & Richardson P.C.

(57) ABSTRACT

Certain embodiments of the invention provide a greeting card having a holder element on the front surface of the greeting card. The holder element is capable of retaining a prepaid gift card or the like. One such embodiment provides the gift-giver with an opportunity to retain the prepaid gift card to the greeting card without reducing the area on the inner surface for writing a personal message to the recipient.

2 Claims, 6 Drawing Sheets

U.S. PATENT DOCUMENTS

D305,728 S * 1/1990 Tufariello ..... D9/704
4,890,402 A 1/1990 Carroll
4,936,769 A 6/1990 Schoenleber
4,951,404 A 8/1990 Lithwick
5,096,058 A 3/1992 Juravin et al.
5,133,496 A 7/1992 Davidson et al.
5,143,279 A 9/1992 Gaines
5,213,371 A 5/1993 Bradley
5,226,532 A 7/1993 Davidson et al.
5,232,087 A 8/1993 Schluger
5,275,438 A * 1/1994 Struhl ..... 281/31
5,281,799 A 1/1994 McIntire et al.
5,288,144 A * 2/1994 Guderyon ..... 312/183
5,349,769 A 9/1994 Okola
D351,619 S * 10/1994 Struhl ..... D19/26
5,377,836 A * 1/1995 Eisenbraun ..... 206/461
5,403,236 A 4/1995 Greig
5,407,076 A 4/1995 Sabet
5,479,732 A 1/1996 Burtch et al.
5,494,544 A 2/1996 Hill et al.
5,506,395 A 4/1996 Eppley
5,608,977 A 3/1997 Burtch et al.
5,629,977 A 5/1997 Fonseca
5,640,447 A 6/1997 Fonseca
5,641,062 A 6/1997 Burton et al.
5,650,209 A 7/1997 Ramsburg et al.
5,667,247 A 9/1997 Ramsburg et al.
D393,656 S * 4/1998 Bear et al. ..... D19/26
5,740,915 A 4/1998 Williams
5,760,381 A 6/1998 Stich et al.
D396,055 S * 7/1998 Ritchey ..... D19/29
5,777,305 A 7/1998 Smith et al.
5,791,474 A 8/1998 Hansen
5,794,631 A 8/1998 Sylvester
5,815,964 A * 10/1998 Douglas ..... 40/124.12
5,822,897 A 10/1998 Ertzan
5,836,095 A 11/1998 Crowell
5,842,629 A 12/1998 Sprague et al.
5,884,456 A 3/1999 Hansen
5,918,394 A 7/1999 Babcock
5,918,909 A 7/1999 Fiala et al.
5,932,869 A 8/1999 Gottlich et al.
5,954,369 A 9/1999 Seabrook
5,958,174 A 9/1999 Ramsberg et al.
6,003,254 A 12/1999 Lorber
6,024,277 A 2/2000 Martin
6,050,493 A 4/2000 Fertig
6,116,655 A 9/2000 Thouin et al.
6,145,665 A 11/2000 Krahn
6,148,550 A 11/2000 Niedfeld
6,209,292 B1 4/2001 Krahn
6,224,108 B1 * 5/2001 Klure ..... 283/74
6,260,703 B1 7/2001 Morton
6,290,060 B1 9/2001 Burtch
6,315,206 B1 11/2001 Hansen et al.
6,349,829 B1 2/2002 Matheis et al.
6,375,080 B1 4/2002 Cremonese
6,439,613 B2 8/2002 Klure
6,454,165 B1 9/2002 Dawson
6,457,649 B1 10/2002 Hileman
6,550,617 B1 * 4/2003 Elva ..... 206/457
6,652,178 B2 * 11/2003 Walton ..... 402/79
2001/0013481 A1 8/2001 Lang
2001/0022446 A1 9/2001 Klure
2001/0045738 A1 11/2001 Klure
2002/0049669 A1 4/2002 Bleser et al.
2002/0050711 A1 * 5/2002 MacWilliams et al. ..... 283/62
2002/0088855 A1 7/2002 Hodes
2002/0091578 A1 7/2002 Thomas
2002/0092214 A1 * 7/2002 Girdler ..... 40/124.06
2002/0100797 A1 8/2002 Hollingsworth et al.
2002/0143697 A1 10/2002 Gotfried

* cited by examiner

GREETING CARD WITH GIFT HOLDER

CROSS-REFERENCE TO RELATED APPLICATION

This application claims the benefit of the filing date of U.S. Provisional Patent Application Ser. No. 60/440,893 filed on Jan. 17, 2003, the entire contents of which are incorporated herein.

TECHNICAL FIELD

This description relates to greeting cards and, in certain embodiments, to greeting cards adapted to hold a gift item.

BACKGROUND

People like to commemorate important events in people's lives, such as weddings, anniversaries, and birthdays, and show their appreciation and affection for others by sending gifts and social expression cards, such as greeting cards. Most greeting cards sent today are mass produced cards purchased in retail establishments such as card shops, gift shops, grocery stores and the like. Gifts, of course, may be purchased at any of a number of retail establishments.

It is not always easy to find a mass produced card that expresses the right sentiment. Additionally, there is a desire on the part of most people to personalize their gifts and greeting cards. Most people write a personal greeting in the mass produced cards that they send to others. Recently, there have been introduced card vending machines or kiosks that enable purchasers to create personalized printed social expression cards. Also, there are software packages that enable people to produce cards using personal computers.

In the area of gifts, most people prefer to give a gift that they believe will be meaningful to and appreciated by the recipient. However, a giver may know only generally the wants and needs of a particular recipient. For example, the giver may know that an intended recipient likes music or a particular style of clothing. However, the giver may not know which musical group the recipient likes or whether the recipient would prefer one article of clothing over another. In such instances, the gift certificate from a store that carries goods of the type appreciated by the recipient might be an appropriate gift.

Gift certificates are now available in the form of prepaid gift cards. Conventional prepaid gift cards are debit cards having a magnetic stripe that encodes a monetary credit amount that can be read by appropriate card reader. Such prepaid gift cards are typically similar in size and shape to standard credit cards and may be used, for example, as a gift certificate or a prepaid merchandise credit toward a purchase at a retail establishment, which is typically identified on the gift card.

People giving a prepaid gift card often find it desirable to accompany the prepaid gift card with a traditional greeting card to make the gift a personal touch. The traditional greeting card provides the giver an opportunity to author a personalized sentiment or the like. Because traditional greeting cards are not adapted to hold a prepaid gift card, the greeting card and prepaid gift card are often presented separately.

SUMMARY

A greeting card may include on its front surface an element adapted to hold a prepaid gift card or the like. In one embodiment, a greeting card comprises a front panel and a rear panel connected at a fold line and a bag element resembling a shopping bag affixed to a forward surface of the front panel and adapted to releasably retain a prepaid gift card.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION OF ILLUSTRATIVE EMBODIMENTS

Figure 1:
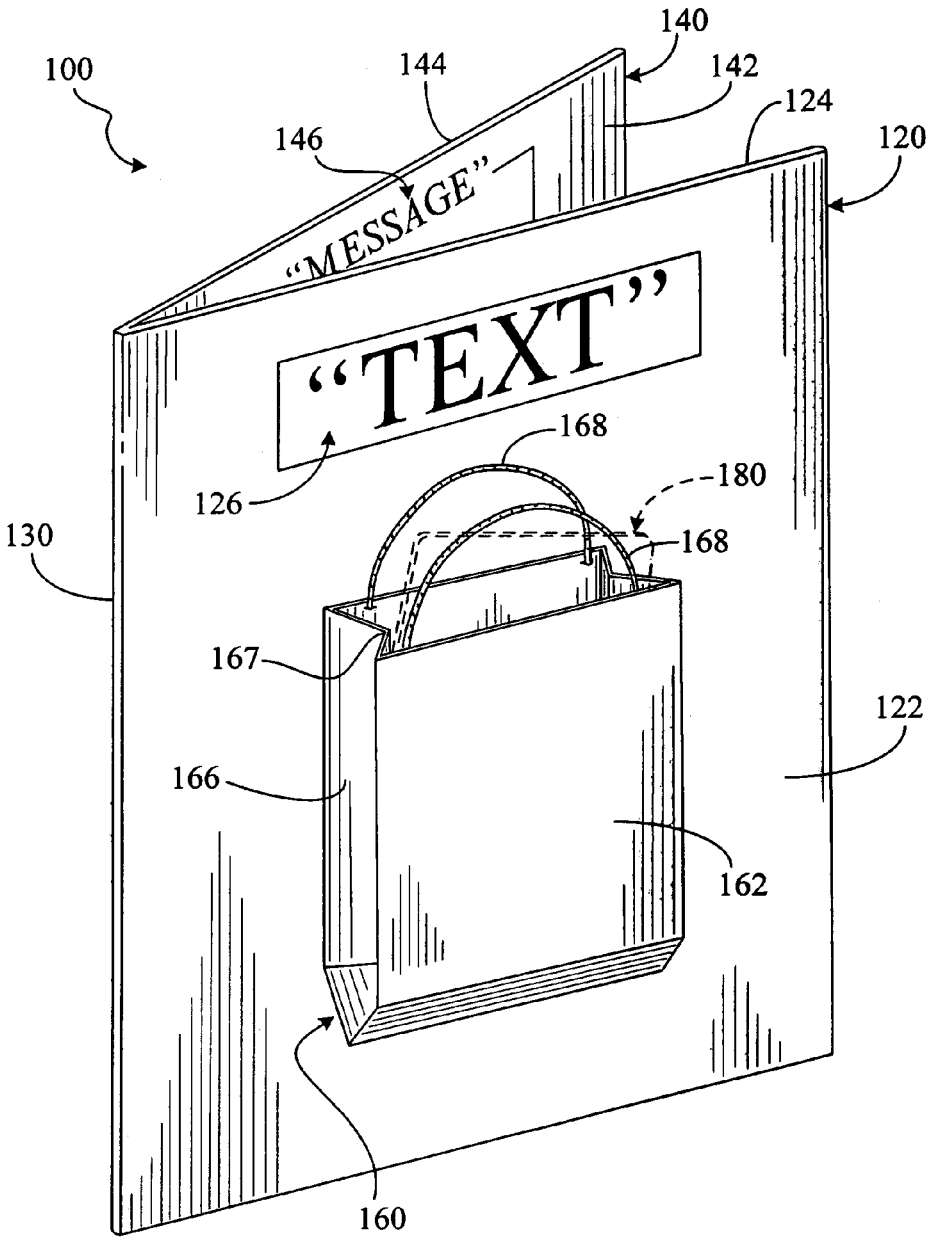
FIG. 1 is a front perspective view of a greeting card in accordance with an embodiment of the invention.

Referring to FIG. 1, a greeting card 100 includes a front panel 120 and a rear panel 140 that are connected at a fold line 130. The front panel 120 includes a front surface 122 and an interior surface 124. Similarly, the rear panel 140 includes a rear surface 142 and an interior surface 144. The panels 120 and 140 are movable about the fold line 130 such that the greeting card 100 may be adjusted between a folded condition and an unfolded condition. When the greeting card 100 is adjusted to a folded condition, as shown for example in FIG. 1, the interior surface 124 of the front panel 120 substantially faces the interior surface 144 of the rear panel 140. When this embodiment of the greeting card 100 is adjusted to an unfolded condition (not shown), the interior surface 124 of the front panel 120 faces in a direction substantially similar to the interior surface 144 of the rear panel 140.

The front and rear panels 120 and 140 can be constructed of any suitable material. For example, the panels 120 and 140 may comprise paper, cardstock, cardboard, plastic, or any combination thereof. Preferably, at least a portion of the front panel 120 or the rear panel 140 is constructed of a material that is suitable for receiving ink or other printing compositions. Various greetings, sentiments, messages, and images may be disposed on the front surface 122, the rear surface, the interior surfaces 124 and 144, or any combination thereof. As shown in FIG. 1, the front surface 122 may include one or more "TEXT" areas 126 that include a label, message, image, or any combination thereof. For example, the "TEXT" area 126 may include a message printed on the front panel 120 such as "HAPPY BIRTHDAY," "HAPPY ANNIVERSARY," "CONGRATULATIONS," or the like. Similarly, at least one of the interior surfaces 124 and 144 may include a "MESSAGE" area 146 that include various greetings, sentiments, messages, and images. For example, the "MESSAGE" area may include a humorous birthday message preprinted on the interior surface 144 of the rear panel 140. Alternatively, one or more of the interior surfaces 124 and 144 may include no preprinted messages, thus providing the gift-giver with a larger area to handwrite a personalize message. The front and rear panels 120 and 140 can be decorated in various colors to provide a pleasant or festive appearance. Images and decorative additions such as ribbons, lace, colored tissue paper, and the like may be included on one or more of the panels 120 and 140.

Figure 4:
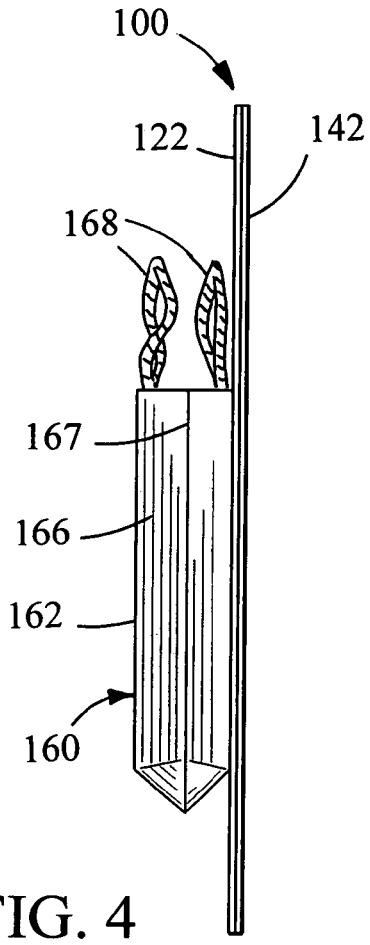
FIG. 4 is a right side view of the greeting card from FIG. 1.
Figure 5:
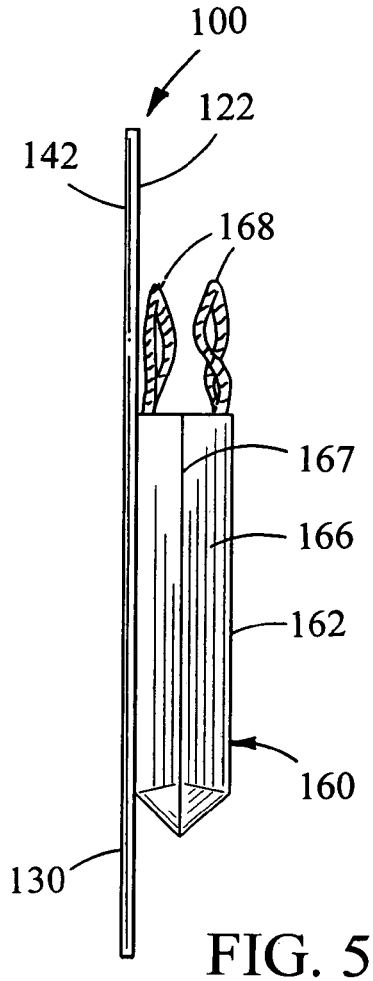
FIG. 5 is a left side view of the greeting card from FIG. 1.

Still referring to FIG. 1, a holding structure 160 is attached to the front surface 122 of the front panel. The holding structure is configured to retain a prepaid gift card 180 or the like in a position that is forward of the front panel 120. As such, the greeting card 100 may be adjusted to a fully folded condition (see, for example, FIG. 4) where the interior surfaces 124 and 144 of the front and rear panels 120 and 140 abut one another without interference from the holding structure 160 or the gift card 180. In addition, the area for printing or writing a message on the interior surfaces 124 and 144 is not limited by the positioning of the gift card 180 or the holding structure 160. For example, a preprinted communication may be printed in the "MESSAGE" area 146 while the complete area on the interior surfaces 124 and 144 is available for the gift-giver to handwrite a personalized message to the recipient. Furthermore, the holding structure 160 and the gift card 180 are prominently positioned on the front side of the greeting card 100 so as to draw the recipient's attention to the holding structure 160 and the gift retained therein. In such an embodiment, the gift card 180 is not necessarily in a secondary position to the front panel 120 of the greeting card 100. Rather, the gift card 180 (which is may have a greater value to the recipient than the greeting card 100) is noticeably positioned forward of the front panel 120 such that the recipient may first receive the primary gift before unfolding the greeting card 100 to view any messages or images that are included on the interior surfaces 124 and 144.

In the embodiment shown in FIG. 1, the holding structure 160 is a collapsible bag structure that is sized to retain a prepaid gift card 180. The bag structure 160 may be adhesively attached to the front surface 122 of the front panel 120 such that at least one surface 162 of the bag structure 160 faces opposite the front panel 120 of the greeting card 100. One or more side sections 166 of the bag structure may include a fold line 167 to facilitate the collapsible motion of the bag structure 160. In addition, the bag structure 160 may include one or more handles 168 so as to provide the appearance of a miniature gift bag or shopping bag. The bag structure 160 may be constructed of paper, cardstock, plastic, or any other suitable material. The handles 168 can be constructed of rope-like material, paper, decorative wire, or the like. The handles 168 may optionally be omitted. The bag structure 160 may have an image or words thereon, contributing to the overall pleasing appearance of the greeting card 100. The shape of the structure 160 may provide a visually appealing appearance and an enjoyable method of delivering a prepaid gift card 180 to a recipient.

Because the structure 160 and the gift card 180 retained therein are prominently positioned for the recipient, the appearance of the holding structure 160 may conveniently incorporated into the theme of the greeting card 100. For example, the holding structure 160 may have the appearance of a miniature shopping bag from the recipient's favorite retail establishment, and a prepaid gift card 180 from that retail establishment may be retained in the bag structure 160. This "shopping" theme may be incorporated into the theme of the greeting card 100 by including the phrase "HAPPY BIRTHDAY . . . LET'S GO SHOPPING!" or the like in the "TEXT" area 126 or the "MESSAGE" area 146 of the greeting card 100. Furthermore, the name or trademark of the retail establishment may be printed on the forward surface 162 of the bag structure 160 and/or the gift card 180 so as to emphasize the "shopping" theme of the gift-giving event.

Figure 6:
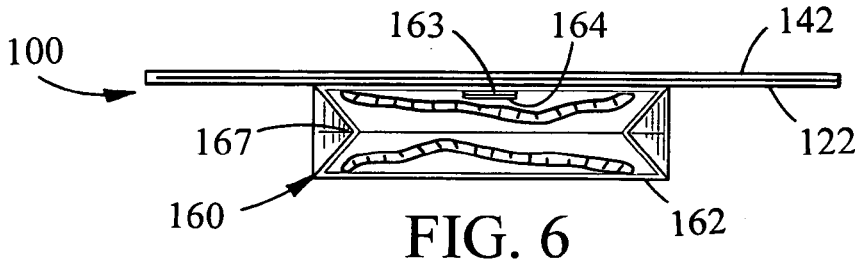
FIG. 6 is a top view of the greeting card from FIG. 1.
Figure 7:
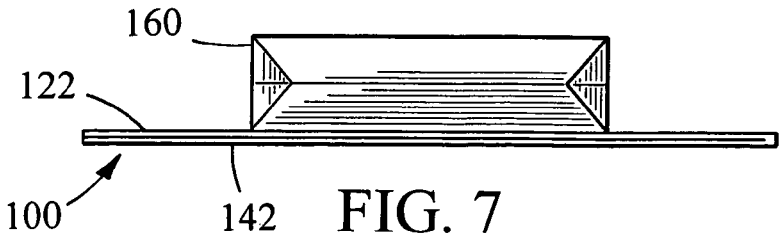
FIG. 7 is a bottom view of the greeting card from FIG. 1.

The holding structure 160 may also include a retention element (not shown in FIG. 1), which operates to releasably retain the gift card 180. For example, the handles 168 of the bag structure 160 may be adapted to be tied, snapped together, or otherwise secured so as to retain the gift card 180 in the bag structure 160. Alternately, the dimensions and pleating in the bag structure 160 may be adapted to frictionally hold the gift card 180 of a predetermined size. As shown by way of example in FIG. 6, adhesive tape 163 with a release liner 164 or other conventional affixation means may be installed within the bag structure 160 to allow a gift-giver to releasably secure the gift card 180 in the bag structure 160 before presenting the greeting card 100 to the recipient.

Figure 2:
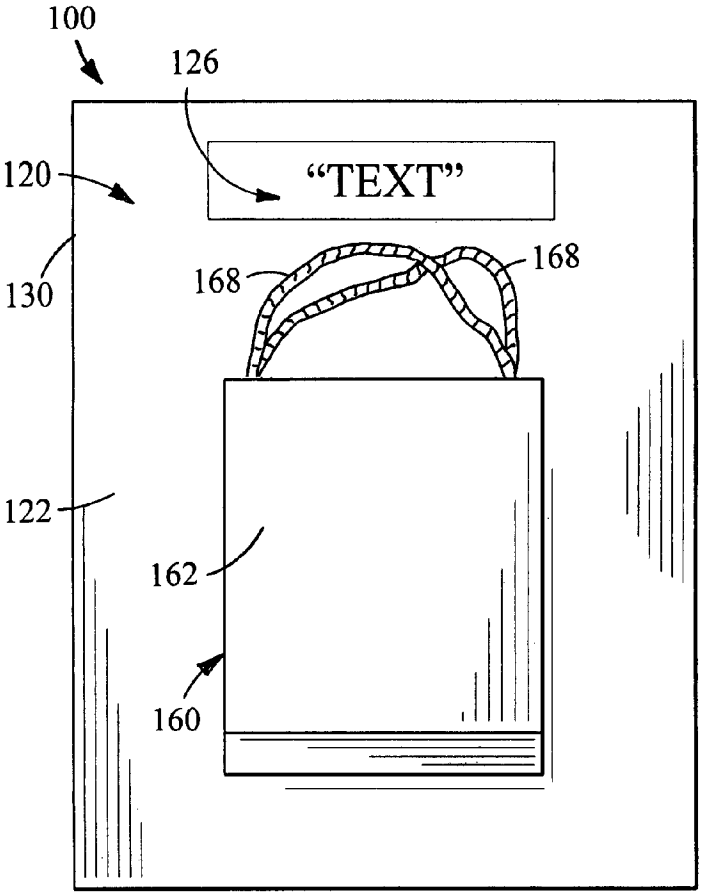
FIG. 2 is a front view of the greeting card from FIG. 1.

Referring to FIG. 2, the holding structure 160 is sufficiently sized to retain a prepaid gift card 180, but may be smaller than the front panel 120. Although the holding structure 160 is shown in FIG. 2 as being approximately centered on the front panel 120, other embodiments may include a holding structure 160 that is attached to the front panel 120 in an off-centered position.

Figure 3:
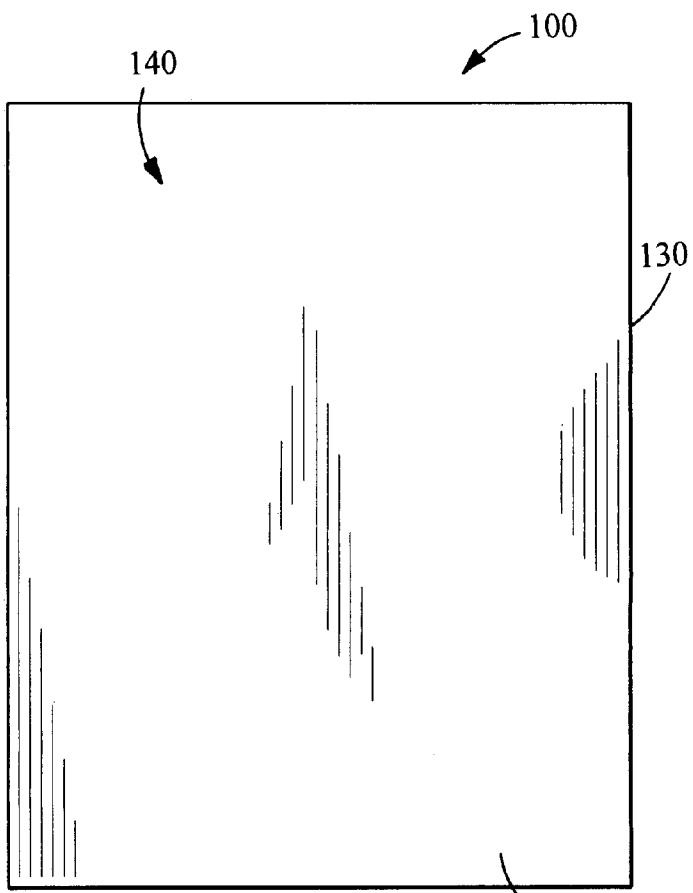
FIG. 3 is a rear view of the greeting card from FIG. 1.

Referring to FIG. 3, the rear surface 142 of the rear panel 140 may include pricing information, advertising information, trademark information, address information, and a bar code identifying the card. Other images or message may also be printed on the rear surface 142 of the back panel 140.

Referring to FIGS. 4–7, the holding structure 160 is attached to the front panel 120 such that the holding structure 160 and any gift card 180 retained therein is positioned forward of the front panel 120. The holding structure 160 may be attached to the front panel 120 by adhesives or by other attachment means. Alternatively, components of the holding structure 160 may be integrally formed with the front panel 120. As shown in FIGS. 4–7, the greeting card 100 may be adjusted to a fully folded condition. The front and rear panels 120 and 140 may be adjusted to the fully folded condition such that the interior surfaces 124 and 144 abut one another without interference from the holding structure 160 or the gift card 180.

The invention is not limited to the illustrative embodiment shown in FIG. 1. For example, the front and rear panels 120 and 140 shown in FIG. 1 are rectangular in shape, and are substantially the same size. In other embodiments, the panels 120 and 140 may have alternative shapes such as the outline of an animal or cartoon character, and the panels 120 and 140 need not be the same size. Also, front panel 120 may consist of a double layer of material (or a larger panel doubled back on itself and attached thereto) to provide additional rigidity. Fold line 130 need not be a continuous fold line, but instead may be broken by gaps or cutouts into fold line sections in certain embodiments.

Figure 8:
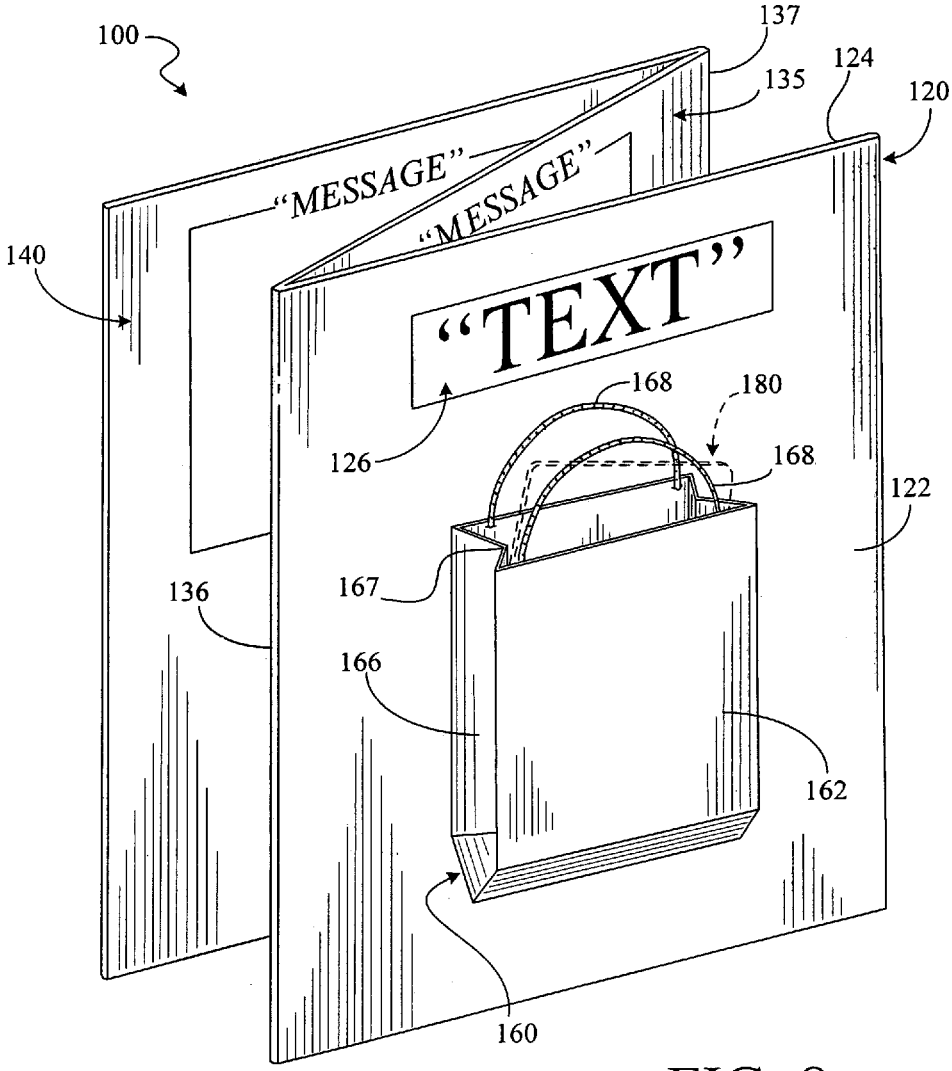
FIG. 8 is a front perspective view of a greeting card in accordance with another embodiment of the invention.

Furthermore, any number of folds or panels may be incorporated into the gift card construction. For instance, additional panels or folds may be used to create a tri-panel card construction. In one example shown in FIG. 8, the front and rear panels 120 and 140 may be interconnected with an intermediate panel 135 such that one fold line 136 connects the front panel 120 and the intermediate panel 135 and another fold line 137 connects the rear panel 140 and the intermediate panel 135.

The greeting card embodiment shown in FIG. 1 may have any orientation. For example, the depicted embodiment is typically referred to as a vertical or portrait orientation. Alternatively, horizontal or landscape orientations may be implemented.

Although the embodiment shown in FIG. 1 is configured to hold a prepaid gift card 180, the holding structure 160 may also hold other gift items, such as monetary currency, banks checks, earrings, a bracelet, a necklace, a ring, or a watch. A personalized note may also be enclosed within the holding structure 160.

Figure 9:
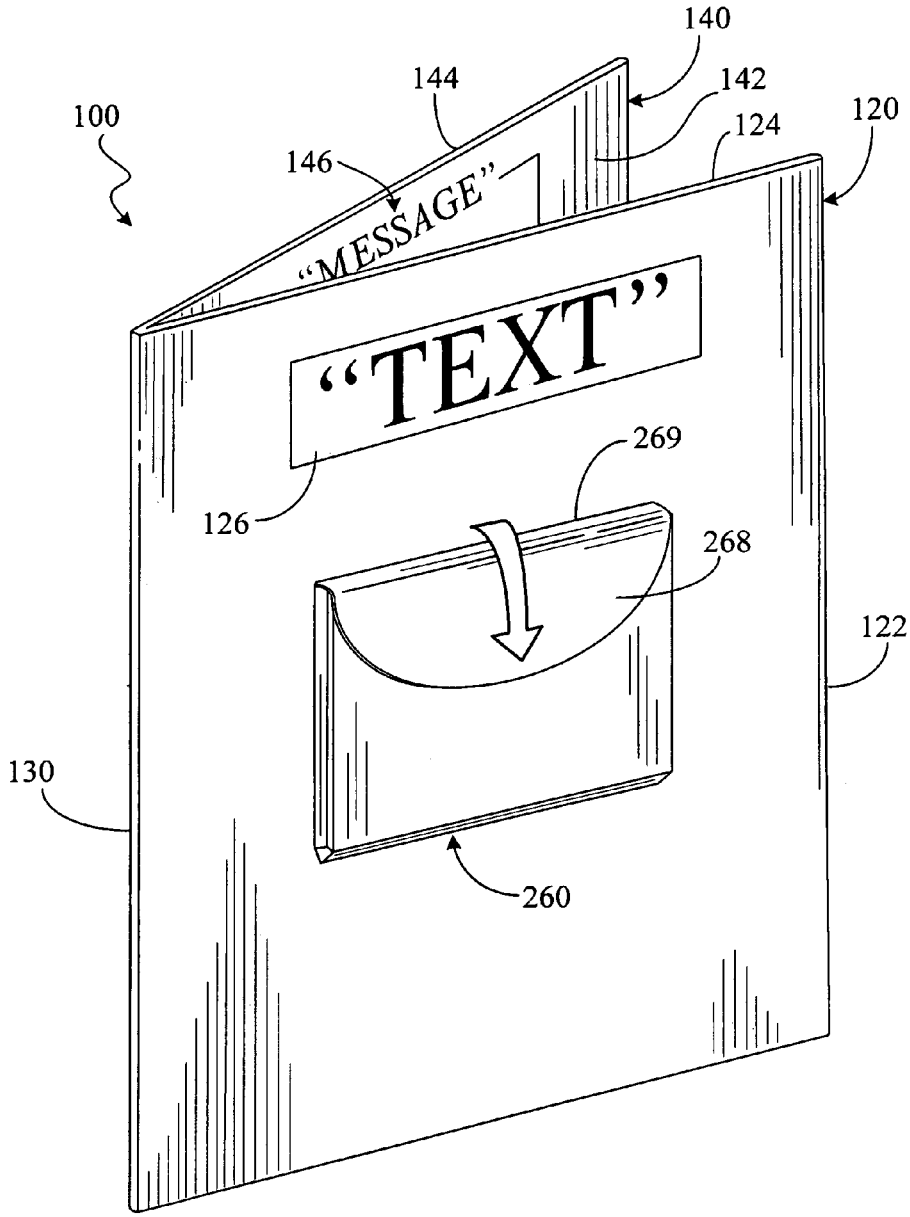
FIG. 9 is a front perspective view of a greeting card in accordance with a further embodiment of the invention.

Other embodiments of the holding structure 160 may have a construction and appearance other than the collapsible bag structure shown in FIG. 1. For instance, an envelope structure that is configured to retain a prepaid gift card may be attached to the front surface 122 of the front panel 120, as shown in FIG. 9. The envelope structure 260 may have the appearance of miniature envelope (e.g., smaller than the typical letter-sized envelope), including a flap portion 268 that is hingedly connected along a fold line 269. The flap portion 268 may be adjusted to a sealed position where the contents (e.g., gift card 180) of the envelope structure 260 are retained therein. The envelope structure 260 may be attached to the front panel 120 using adhesive or other attachment means such that the flap portion 268 faces forward of the front panel 120 and may be freely adjusted about the envelope fold line 269 to the sealed position.

Figure 10:
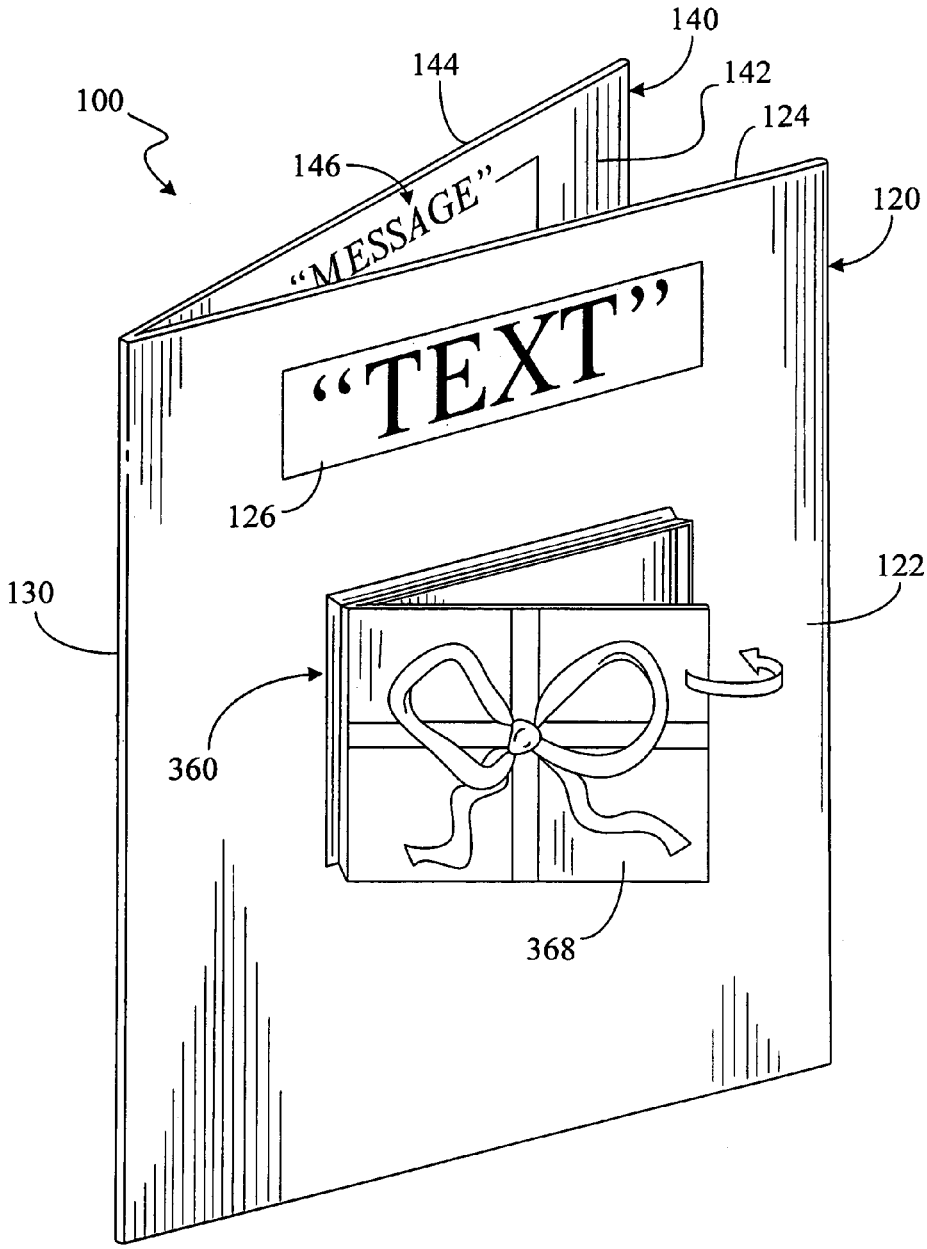
FIG. 10 is a front perspective view of a greeting card in accordance with an embodiment of the invention.

In another example shown in FIG. 10, a box structure 360, rather than the collapsible bag structure, may be attached to the front panel 120 of the greeting card 100. The box structure 360 may be capable of retaining a prepaid gift card 180 and may have the appearance of a miniature gift box that is adorned with colored paper, ribbon, and other decorations. The box structure 360 may include an open top surface that is covered using a lid 368. The lid 368 may be hingedly attached to (refer to FIG. 10) or separable from the box structure. The box structure 360 may be attached to the front panel 120 of the greeting card 100 such that the lid 368 is adjustable to uncover the open top surface and reveal the contents therein (e.g., gift card 180). In some embodiments the box structure 360 may be attached to the front panel using adhesive or other attachment means. Alternativeiy, the box structure may be formed integrally with the front panel so that the box structure is positioned forward of the front surface 122 of the front panel 120.

Further yet, the holding structure 160 may be a sleeve structure attached to the front surface 122 of the front panel 120. The sleeve is capable of retaining a gift card 180 in a position forward of the front panel 120 and may resemble a miniature version of typical 9"×12" open-ended envelopes. The sleeve may be attached to the front panel using adhesive or other attachment means or may be formed integrally with the front panel.

In another embodiment, the holding structure 160 may be a pocket structure that is attached to the front panel 120 of the greeting card 100. The pocket structure may be formed by affixing a substantially planar piece of any suitable material, such as plastic, paper, or cardstock, to the front surface 122 of the front panel 120. The pocket structure is capable of retaining a gift card 180 therein. For example, the pocket structure may be appropriately sized such that the gift card 180 is friction-fit to the pocket in a position that is forward of the front surface 122.

In addition, the holding structure 160 may be a net-type pocket on the front surface 122 of the panel 120. The net-type structure may be formed using lengths of string, cord, or the like. The net-type structure may be attached to the front surface 122 with adhesive or other attachment means. Alternatively, the net-type pocket structure may be attached to the front panel 120 by weaving the ends of the string through holes or grommets in the front panel 120 and securing the ends on the backside of the front panel 120.

In some embodiments, more than one holding structure 160 may also be used on a single front panel 120, and the multiple holding structures 160 may be configured to hold a gift item cooperatively.

A number of embodiments of the invention have been described. Nevertheless, it will be understood that various modifications may be made without departing from the spirit and scope of the invention.

What is claimed is:

1. A greeting card comprising:

a front panel and a rear panel, the front panel having a front surface, a plurality of peripheral edges, and an interior surface, wherein the greeting card is operable to be adjusted to a folded condition such that the interior surface of the front panel substantially faces the rear panel, further comprising a third panel that interconnects the front panel and the rear panel, the front panel being connected to the third panel at a first fold line and the rear panel being connected to the third panel at a second fold line; and a means for retaining and substantially enclosing a gift card, the retaining means being attached to the front surface of the front panel and being positioned forward of the front panel, the retaining means being spaced apart from the peripheral edges of the front panel so that a substantial portion of the front surface of the front panel is viewable, wherein the retaining means includes at least one adjustable portion connected at a fold line, wherein the retaining means is operable to releasably retain the gift card in a position forward of the front panel when the greeting card is in the folded condition.

2. A greeting card comprising:

a front panel and a rear panel connected at a fold line, the front panel having a front surface and an interior surface such that the interior surface substantially faces the rear panel when the greeting card is in a folded condition, further comprising a third panel that interconnects the front panel and the rear panel, the front panel being connected to the third panel at a first fold line and the rear panel being connected to the third panel at a second fold line; and a container attached to the front surface, the container at least partially defining an internal space, the container being operable to releasably retain at least a portion of a prepaid gift card in the internal space, wherein when the prepaid gift card is releasably retained by the container, at least one dimension of the prepaid gift card is larger than the internal space such that the prepaid gift is partially exposed, wherein the front panel includes a top edge and a left edge, the container has an opening that faces toward the top edge of the front panel, and the fold line at which the front panel and rear panel are connected is disposed proximal to the left edge of the front panel.

* * * * *